United States Patent [19]

Duret

[11] Patent Number: 4,628,888

[45] Date of Patent: Dec. 16, 1986

[54] DEVICE AND METHOD FOR INJECTING FUEL INTO AN ENGINE, ASSISTED BY COMPRESSED AIR OR GAS

[75] Inventor: Pierre Duret, Paris, France

[73] Assignees: Institut Francais du Petrole; Automobiles Peugeot; Automobiles Citroen, all of France

[21] Appl. No.: 814,882

[22] Filed: Dec. 30, 1985

[30] Foreign Application Priority Data

Dec. 28, 1984 [FR] France ..... 84 20059

[51] Int. Cl.[4] ..... F02M 23/00

[52] U.S. Cl. ..... 123/531; 123/534; 123/533; 123/568

[58] Field of Search ..... 123/531, 534, 532, 533, 123/568, 585, 65 PE, 65 P, 65 EM, 463, 73 B, 73 C

[56] References Cited

U.S. PATENT DOCUMENTS

| | | | |
|---|---|---|---|
| 1,551,731 | 9/1925 | Charter | 123/532 |
| 3,894,520 | 7/1975 | Clawson | 123/531 |
| 3,996,906 | 12/1976 | Bubriak et al. | 123/531 |
| 4,033,302 | 7/1977 | Jarnuszkiewicz | 123/534 |
| 4,361,126 | 11/1982 | Knapp et al. | 123/585 |
| 4,453,502 | 6/1984 | Resler, Jr. | 123/568 |
| 4,516,551 | 5/1985 | Urushidani | 123/568 |

*Primary Examiner*—Raymond A. Nelli

*Attorney, Agent, or Firm*—Antonelli, Terry & Wands

[57] ABSTRACT

A device and method are provided for the pneumatic injection of fuel into an engine. The device comprises at least one auxiliary duct having two ends one of which is connected to an exhaust pipe and the other to an injection member.

21 Claims, 13 Drawing Figures

DEVICE AND METHOD FOR INJECTING FUEL INTO AN ENGINE, ASSISTED BY COMPRESSED AIR OR GAS

BACKGROUND OF THE INVENTION

1. Field of the Invention

The present invention relates to a device and method for allowing and/improving the injection of fuel assisted by compressed air or gas, or pneumatic injection, into an internal combustion engine comprising at least one pump crank case. The present invention is more especially applicable to a two stroke engine with air scavenging.

2. Description of the Prior Art

In the particular case of a two stroke engine with crank case scavenging during a considerable part of the air and fuel intake cycle, the transfer and exhaust ports are open simultaneously and a part of the air-fuel mixture admitted escapes to the atmosphere before the exhaust ports are closed, which results in a considerable reduction of the efficiency and considerable discharges of pollutants.

The injection of fuel assisted by air coming from the crank case overcomes this disadvantage. An example has been proposed by M. J. A. Culmann in the French patent FR No. 490.166. In this patent, scavenging of the cylinder takes place solely with the air coming from the pump crank case, another part of the air from the pump crank case is fed at a pressure close to the maximum pressure reached in this housing, into a sealed chamber which serves as compressed air source for supplying the pneumatic fuel injection device.

It has been discovered that such a device operated better when it was fed with compressed air at a pressure higher than that reigning in the pump crank case.

The prior art may be illustrated by the British patent No. GB-A-572.080, the German patent No. DE-C-833.885, the U.S. Pat. No. 31,902,701 and the French patent No. FRA-2 292 111.

SUMMARY OF THE INVENTION

The device of the invention uses the pressure wave effect reigning in the exhaust pipes for increasing the pressure in the sealed chamber by introducing therein air and/or exhaust gases. The result is a better quality of pneumatic injection, an increased filling of the engine with air, an increase in the amount of residual burnt gases resulting in a reduction of nitrogen oxide discharges, partial recovery of the fuel short circuited to the exhaust and a possible reduction of noise due to the exhaust pressure wave effects.

Thus, the present invention relates to an internal combustion engine comprising a means for pneumatic injection of the fuel, an exhaust pipe and a pump crank case.

It is characterized in that the engine comprises a chamber connecting the pump crankcase to the injection means, this chamber forming an injection chamber, an auxiliary duct connecting the exhaust pipe to said injection chamber, and in that said injection chamber comprises an obstruction means, such as a stop valve or non return valve, this means being located before the connection of the auxiliary duct to the injection chamber.

The auxiliary duct may comprise an obstruction member such as a stop valve or non return valve, this member opening intermittently under the effect of a mechanical control such as a cam, pneumatic control, electropneumatic control etc.

Still within the scope of the invention, said auxiliary duct may comprise a third aperture opening into a gaz source and an obstruction means placed on said aperture such as a stop valve or non return valve.

The end of the auxiliary duct connected to the exhaust pipe may be preferably positioned in this pipe at a position where the pressure wave is maximum.

The end of the auxiliary duct connected to the exhaust duct may have a convergent shape whose section decreases from the exhaust pipe towards the auxiliary duct.

The present invention may be applied to an engine comprising at least two cylinders each of which comprises an exhaust pipe, an injection member and an injection chamber connected to said injection member of one of the cylinders, or cylinder considered. In this case, the engine may also comprise at least one crossed auxiliary duct connecting said injection chamber to the exhaust pipe of the other cylinder.

If it is the cylinder considered which comprises a pump crank case, the engine may comprise at least one injection chamber connecting said pump crank case to the injection member of the cylinder considered and the crossed auxiliary duct may connect the exhaust pipe of the other cylinder to the injection chamber of the cylinder considered.

The present invention may be applied to an engine comprising at least two cylinders, each of these cylinders having an exhaust pipe and an injection means. In this case, the engine may also comprise at least two auxiliary crossed ducts, each of them connecting the exhaust pipe of one of the cylinders to the injection means of the other cylinder.

If this engine is an engine whose cylinders comprise a pump crank case, it may also comprise at least two injection chambers, each of them connecting the pump crank case of one of the cylinders, or cylinder considered, to the injection means of the same cylinder and each of the auxiliary ducts may connect the exhaust pipe of the other cylinder to the injection chamber connected to the injection means of the cylinder considered;

The present invention may be applied to an engine comprising at least two cylinders, one at least of which comprises a pump crank case. In this case, the engine may comprise at least one so called crossed injection chamber connecting said pump crank case to the injection member of the other cylinder.

Still within the scope of the present invention, this other cylinder may comprise an exhaust pipe and an auxiliary duct which connects the exhaust pipe of this other cylinder to the crossed injection chamber connected to the injection member of this same cylinder.

The present invention may be applied to an engine having at least two cylinders each equipped with a pump crank case. In this case the engine may comprise at least two crossed injection chambers, each of them connecting the pump crank case of one of the cylinders to the injection member of the other cylinder.

Still within the scope of the present invention, the engine may comprise at least two auxiliary ducts, each of them connecting the exhaust pipe of one of the cylinders, or cylinder considered, to the injection chamber connected to the injection means of this same cylinder.

Thus it is apparent that, in the case of multicylinders, the present invention provides numerous combinations of communications between the exhaust pipes of the different cylinders and the injection means, as well as between the pump crankcases and the injection members.

Similar combinations are also possible within the scope of the present invention, more especially when the engine comprises an exhaust manifold or if it comprises a common injection chamber communicating with several pump crank cases and at least one injection member. For example, still within the scope of the present invention, an auxiliary duct may be connected to an injection means via the common injection chamber, or not.

The injection chamber may be formed by a duct, this is moreover the preferred embodiment.

The present invention also provides a method for providing fuel injection in an internal combustion engine equipped with a pneumatic injection means and an exhaust pipe and comprising a pump crank case. This method is characterized in that a communication is formed between the exhaust duct and the injection means, in that the part of the compressed gases coming from the pump housing is directed towards the injection means and is combined with the gases coming from the communication between the exhaust and the injection means.

Still within the scope of the present invention, the communication may be placed in relation with a gaz source via an obstruction means such as a stop valve or non return valve.

When the engine to which the method of the invention applies comprises at least two cylinders each of which comprises an exhaust pipe and an injection means, at least one so called crossed communication may be provided connecting the exhaust pipe of one of the cylinders or cylinder considered to the injection means of the other cylinder.

If the method of the invention is applied to an engine in which each of said cylinders comprises a pump crank case and a transfer duct, a part of the compressed gases coming from the pump crank case of said cylinder considered may be directed towards the injection member of the same cylinder and be combined with the gases coming from the communication between the exhaust pipe of the other cylinder with the injection member of the cylinder considered.

If the method of the invention is applied to an engine comprising at least two cylinders, at least one of these cylinders comprising a pump crank case, a part of the compressed gases coming from the pump crank cases may be directed towards the injection member of another cylinder.

When the method of the invention is applied to an engine in which each cylinder comprises an exhaust pipe, the communication may connect the exhaust pipe of this other cylinder to the injection means of this same cylinder and at least a part of the compressed gases coming from said pump crank case may be directed towards the injection member and be combined with the gases coming from the communication.

BRIEF DESCRIPTION OF THE DRAWINGS

The advantages and features of the invention will be clear from the following description, given by way of non limitative example, with reference to the accompanying Figures in which.

DESCRIPTION OF THE PREFERRED EMBODIMENTS

Figure 1:
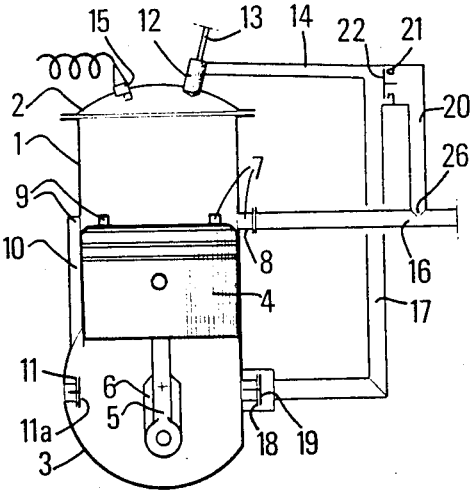
FIG. 1 shows schematically and in section a two stroke engine with scavenging by the crank case, with fuel injection assisted by compressed air or gas coming from a tube or sealed chamber fed with air by the crank case and equipped with a device of the invention.

FIG. 1 is a schematical representation of a cylinder of a two stroke engine with fuel injection assisted by compressed air and equipped with a device of the invention.

Reference 1 designates the cylinder closed at its upper part by the cylinder head 2 and which communicates at its lower part with a sealed crank case 3.

In the cylinder moves the piston 4 connected by the connecting rod 5 to the crank shaft 6.

Ports 7 formed in the wall of cylinder 1 communicate with the exhaust pipe shown schematically at 8.

Ports 9 formed in the wall of cylinder 1 allow air to be introduced into the cylinder. These ports 9 communicate with the sealed crank case 3 through the transfer channel 10.

Ports 7 and 9 are arranged and dimensioned in a way known per se for ensuring efficient filling of the cylinder and as complete a discharge as possible of the burnt gases.

Crank case 3 is provided with an air intake orifice 11 equipped with a valve shown schematically at 11*a* and which is, for example, a blade valve. Orifice 11 is connected to an air filter not shown. Valve 11*a* is open and lets air penetrate into crank case 3 when the pressure in the crank case is lower than the pressure of the feed air. Valve 11*a* closes as soon as the pressure in crank case 3 is higher than the pressure of the feed air.

Crank case 3 communicates with a sealed chamber 17 of volume V through an orifice 18 equipped with a valve 19 such as a blade valve.

Valve 19 opens for placing chamber 17 in communication with the rest of the crank case when the pressure in chamber 17 is less than the pressure reigning in the rest of the crank case. The valve closes, isolating chamber 17 from the rest of the crank case, when the pressure in the chamber 17 is greater than the pressure reigning in the rest of the crank case.

A member for the pneumatic injection of fuel shown schematically at 12, allows a pressurized carburetted air mixture to be fed into cylinder 1. For this, member 12 is connected to a fuel supply duct 13 and to a compressed air and/or gas supply duct 14 which communicates with chamber 17. This member and its control means will be described in detail hereafter.

Cylinder head 2 also comprises a spark plug 15 whose electric supply circuit has not been shown.

The device of the invention comprises an auxiliary duct or tube 20 connecting the exhaust pipe 16 with the sealed chamber 17, communication between tube 20 and the sealed chamber 17 taking place through an orifice 21 equipped with a valve 22 such as a blade valve.

Valve 22 opens for placing tube 20 in communication with the sealed chamber 17 when the pressure in the tube is greater than the pressure reigning in the sealed chamber. Valve 22 closes, isolating chamber 17 from tube 20, when the pressure in the chamber is higher than that reigning in tube 20.

The operation of the engine is described here after with reference to FIGS. 2 to 6.

Figure 2:
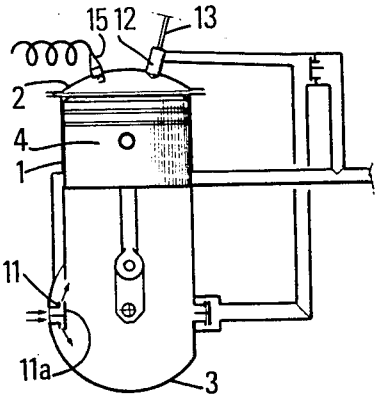
FIGS. 2 to 6 illustrate the operation of this engine.

In FIG. 2, piston 4 has reached the top dead center by moving towards the cylinder head 2. The intake 9 and exhaust 7 ports are closed by piston 4. Valve 11*a* is open letting air penetrate into the crank case through orifice 11. Valve 19 is closed. Valve 22 is closed.

Figure 3:
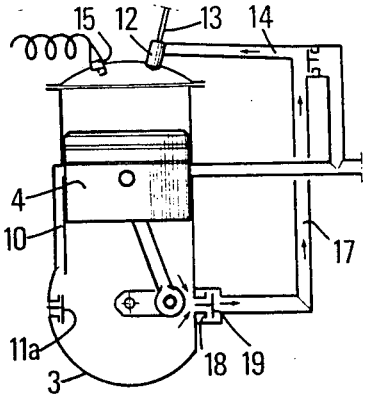
Figure 4:
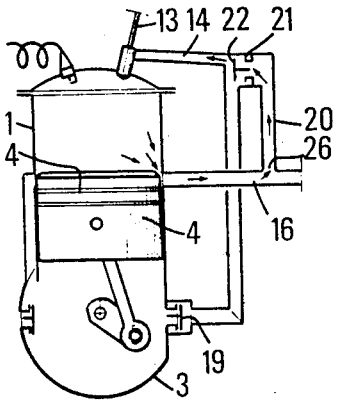
Figure 5:
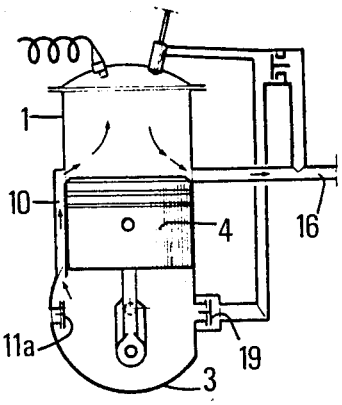

Under the action of the combustion initiated by the spark plug 15, piston 4 moves away from the cylinder head 2 while compressing the air contained in crank case 3 which causes valve 11a to close. When the pressure is greater than that reigning in chamber 17, valve 19 opens (FIG. 3). The pressure in the whole of the crank case continues to rise progressively as the piston 4 moves.

When the sudden opening of the exhaust ports 7 occurs (FIG. 4) a high incident pressure wave (exhaust blast) is formed and propagates in the exhaust pipe 16 and in tube 20. When this positive pressure wave reaches orifice 21, with the pressure in tube 20 higher than in chamber 17, valve 22 opens and a part of the gas contained in tube 20 (exhaust gas formed by a mixture of burnt gases, air and possibly fuel coming from the short circuiting) is fed into chamber 17 whose pressure is thus increased.

When the piston uncovers the transfer ports 9 (FIG. 5), the pressurized air contained in crank case 3 is introduced into cylinder 1 through the transfer channel 10 and ports 9. The pressure in the crank case decreases and valve 19 closes. The pressure of the air stored in chamber 17 would then be equal to the maximum pressure reached in the whole of crank case 3 if the engine were not equipped with the device of the invention.

The length of tube 20 may be calculated so that the positive exhaust pressure wave arrives at orifice 21 for filling chamber 17 after the transfer ports 9 have opened, i.e. when crank case 3 has finished supplying chamber 17 so as not to disturb or decrease this supply, this is particularly true when there is a delay between opening of the transfer port relatively to the opening of the exhaust ports. The shape of tube 20 is designed so as to promote the wave effect. That may be a tube whose curvature is regular and may also comprise sudden or progressive section changes for example in the form of divergent or convergent cones.

Thus, when member 12 is actuated, it is supplied with air and exhaust gas through duct 14 at maximum pressure. The time of introducing the pressurized carburetted mixture is determined by the setting of the means controlling member 12 so that there is practically no loss of carburetted mixture through the exhaust ports, the supply pressure of the injector at that time being greater than that reigning in the cylinder.

Figure 6:
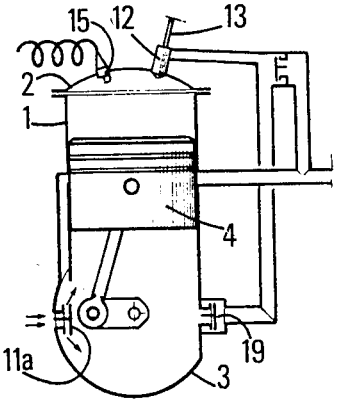

Then piston 4 moves towards the cylinder head 2 creating a compression of the carburetted mixture in cylinder 1 and depression in crank case 3. Valve 19 remains closed whereas valve 11a opens letting air penetrate into crank case 3 (FIG. 6).

The above described operating steps are then reproduced in the same order.

Figure 7:
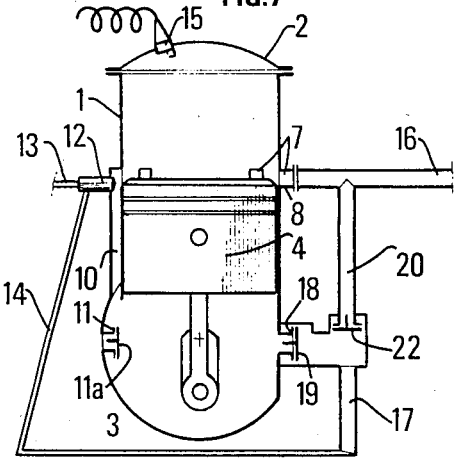
FIGS. 7, 8 and 9 show variants of construction.

It would still be within the scope of the invention to dispose the fuel spraying member 12 fixed in the cylinder head 2 of the engine in the transfer channel 10 so that it introduces the carburetted mixture through intake orifices as shown schematically in FIG. 7, as well at any other position on the effective volume of the cylinder.

Of course, the exact position of fitting member 12 to the cylinder head 2 or the transfer channel 10, or the cylinder, will be determined by the technician so that the amount of carburetted mixture which excapes through ports 7 before burning is zero or as small as possible.

Still within the scope of the invention, the invention may be applied to a four stroke engine or to a two stroke engine having pump crank cases and comprising valves.

Figure 8:
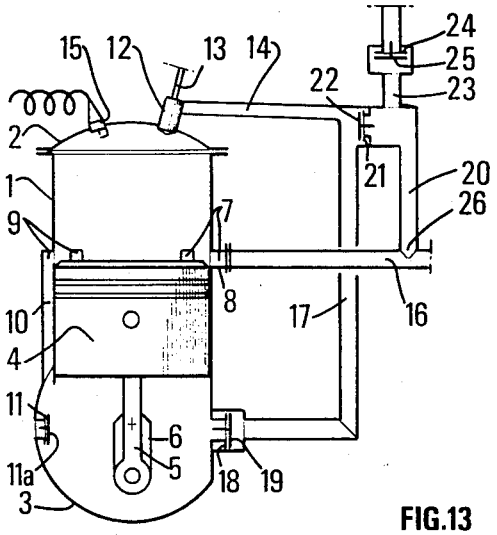

A variant of the device consists in adding to the above described engine assembly, on tube 20, a short tube 23 opening into the free air or into an air filter through orifice 24 or into a gaz source such as a source of carburetted mixture. The orifice is equipped with a valve 25 which may for example be a blade valve (FIG. 8).

When the positive exhaust pressure wave has reached orifice 21 and participated in filling chamber 17, i.e. when valve 22 is closed, it may be followed, provided that an adapted configuration of the exhaust pipe is provided, by a negative pressure wave which, after passing through tube 23, reaches orifice 24 and causes valve 25 to open, the pressure in tube 23 being then less than the atmospheric pressure of the outside air. Air is therefore introduced and sucked into tubes 19 and 23.

It is this air instead of the escaped gases which will be then fed, in the next engine cycle, through orifice 21 into chamber 17 in accordance with the above described mechanism using the positive exhaust pressure wave caused by the sudden opening of the exhaust ports 7.

The position 26 (whether in the case of FIG. 1 or in that of FIG. 8) of the connection of tube 20 to the exhaust pipe 16 is judiciously chosen so as to obtain a sufficient wave effect.

In the case of an insufficient wave effect for opening valve 22 and so for reaching in tube 20 a pressure greater than that in the sealed chamber 17, any exhaust configuration or any device may be used for artifically increasing the pressure wave effects.

Figure 9:
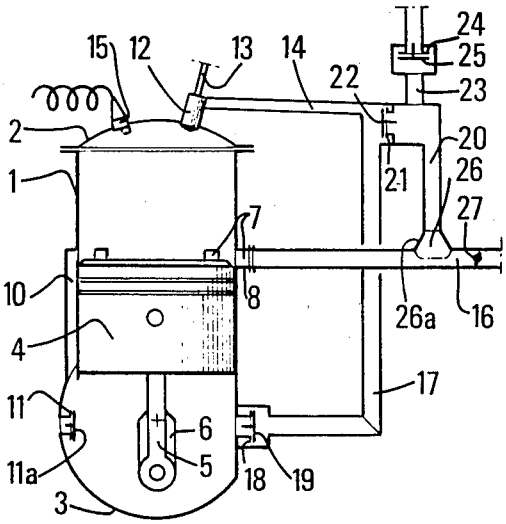

An example of such a device may be a butterfly valve 27 placed just after the connection 26 in pipe 16 (FIG. 9) whose opening angle may be corrected depending on the operating characteristics of the engine.

Another example concerning the duct configuration would be to give a convergent form 26*a* (FIG. 9) to duct 20 at the level of the connection 26 to the exhaust pipe, this convergent shape having a section which decreases from the exhaust pipe 16 towards duct 20.

Figure 10:
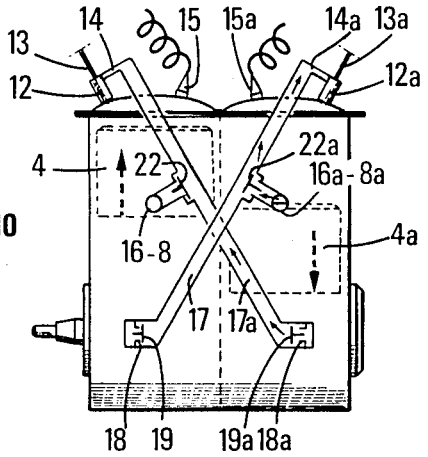
Figure 11:
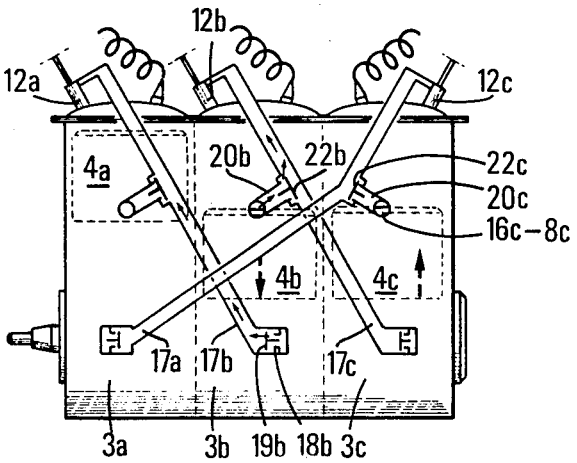
Figure 12:
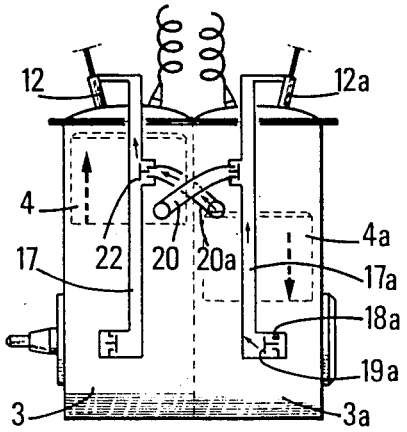

In the case of a two stroke multicylinder engine, different combinations could be contemplated: a sealed chamber per cylinder, this is the case of FIGS. 10, 11 and 12, or on the contrary common to different cylinders. In the first case, the sealed chambers 17, 17*a* and 17*b* and/or 17*c* may be fed by the crank case 3, 3*a*, 3*b* and/or 3*c* of the cylinder into which they inject the air, case of FIGS. 12 and possibly 1 or on the contrary through the crank case of one of the other cylinders, case of FIGS. 10 and 11. Similarly, each tube 20 of the invention corresponding to the injection into a cylinder could in fact be connected (communication 26) to the exhaust pipe 16 of the same cylinder, case of FIGS. 10, 11 and possibly 1, as well as to that of a different cylinder, case of FIG. 12.

A particular example of application could, in the case of a multicylinder, be to have the sealed chamber pressurized by the crank case of another cylinder and the exhaust communicating with the sealed chamber serving for injection into its own cylinder. In this case, a very short tube 20 may be sufficient for it is no longer indispensable for the positive wave to arrive after opening of the transfer ports. In this case the geometry of tube 20 may also be used for increasing the pressure wave effects (for example by a short and convergent tube 20).

FIGS. 10 and 11 show therefore such applications to two and three cylinder engines. The principle may be generalized to engines with a higher number of cylinders.

Conversely, another possibility (FIG. 12) is that each cylinder has its own sealed chamber fed by its own crank case and by a tube 20 coming from the exhaust of one of the other cylinders.

Finally, another possibility is to use a sealed chamber common to all the cylinders or only to some cylinders and fed by each crank case of the engine and by tubes 20 coming from each exhaust, this sealed chamber being connected to at least some injection members of the engine.

Figure 13:
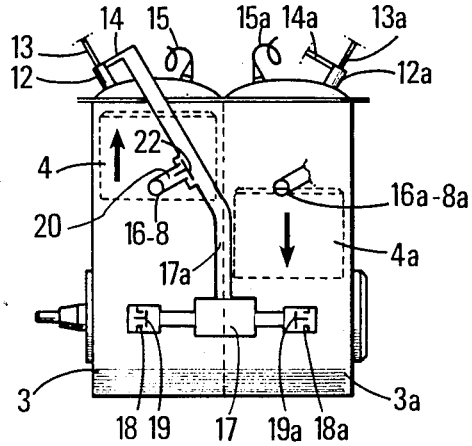
FIGS. 10, 11, 12 and 13 show examples of particular applications in the case of multicylinder engines.

FIG. 13 shows the case of a chamber 17' connected to two different pump crank cases 3 and 3*a*. This chamber is extended by a duct 17*a'* as far as a spraying member 12. Furthermore, this duct is connected to a duct 17*a'* of exhaust 16 through an auxiliary duct 20.

Of course, chamber 17' may be connected to one or more spraying members.

What is claimed is:

1. In an internal combustion engine comprising at least one pneumatic fuel injection member, at least one exhaust pipe and a pump crank case, a chamber is provided connecting said crank case to said injection member, said chamber forming an injection chamber, an auxiliary duct connecting said exhaust pipe to said injection chamber and said injection chamber comprising an obstruction member, such as a stop valve or non return valve, this member being located before the connection of said auxiliary duct to said injection chamber.

2. The engine as claimed in claim 1, wherein said auxiliary duct comprises an obstruction member such as a stop valve or non return valve.

3. The engine as claimed in claim 1, wherein said auxiliary duct comprises a third aperture opening to an air source and an obstruction member placed on said aperture such as a stop valve or non return valve.

4. The engine as claimed in claim 1, wherein the end of said auxiliary duct connected to the exhaust pipe is positioned in this pipe at a position where the pressure wave is maximum.

5. The engine as claimed in claim 1, wherein the end of said auxiliary duct connected to the exhaust pipe has a convergent shape whose section decreases from the exhaust pipe towards the auxiliary duct.

6. The engine as claimed in claim 1, comprising at least two cylinders one of which comprises an exhaust pipe and an injection member and an injection chamber connected to the injection member of one of the cylinders, or cylinder considered further comprising a crossed auxiliary duct connecting said injection chamber to the exhaust pipe of the other cylinder.

7. The engine as claimed in claim 6, in which said cylinder considered comprises a pump crank case, further comprising at least one injection chamber connecting said pump crank case to the injection member of the cylinder considered and wherein the crossed auxiliary duct connects the exhaust pipe of the other cylinder to the injection chamber of the cylinder considered.

8. The engine as claimed in claim 1, comprising at least two cylinders each of which comprises an exhaust pipe and an injection member, further comprising at least two crossed auxiliary ducts, each of them connecting the exhaust pipe of one of the cylinders to the injection member of the other cylinder.

9. The engine as claimed in claim 6, each of said cylinders comprising a pump crank case, and further comprising at least two injection chambers, each of them connecting the pump crank case of one of the cylinders, or cylinder considered, to the injection member of this same cylinder and each of the auxiliary ducts connecting the exhaust pipe of the other cylinder to the injection chamber connected to the injection member of the cylinder considered.

10. The engine as claimed in claim 1, comprising at least two cylinders, at least one of these cylinders comprising a pump crank case, further comprising at least one so called crossed injection chamber connecting said pump crank case to the injection member of the other cylinder.

11. The engine as claimed in claim 10, in which said other cylinder comprises an exhaust pipe, further comprising at least one auxiliary duct connecting the exhaust pipe of said other cylinder to the crossed injection chamber to the injection member of this same cylinder.

12. The engine as claimed in claim 1, comprising at least two cylinders, each of these cylinders having a pump crank case, further comprising at least two crossed injection chambers, each of them connecting the pump crank case of one of the cylinders to the injection member of the other cylinder.

13. The engine as claimed in claim 12, in which each cylinder comprises an exhaust pipe, further comprising at least two auxiliary ducts, each of them connecting the exhaust pipe of one of the cylinders, or cylinder considered, to the injection chamber connected to the injection member of this same cylinder.

14. The engine as claimed in claim 1, comprising at least two cylinders each having a pump crank case, further comprising a common injection chamber connected to said pump crank cases via obstruction members such as a stop valve or non return valves, said injection chamber being further connected to at least one injection member, and at least one auxiliary duct being connected to said injection chamber.

15. The engine as claimed in one of claims 1 to 14, wherein said injection chamber is formed by a duct.

16. A method for effecting the injection of fuel in an internal combustion engine equipped with a pneumatic injection member and an exhaust pipe and comprising a pump crank case, wherein communication is established between the exhaust pipe and the injection member and a part of the compressed gases coming from the pump crank case is directed towards the injection member and is combined with the gases coming from said communication between the exhaust and the injection member.

17. The method as claimed in claim 16, wherein said communication is placed in relation with an air source via an obstruction member such as a stop valve or a non return valve.

18. The method as claimed in claim 16 applied to an engine comprising at least two cylinders each of which comprises an exhaust pipe and an injection member, wherein at least one so called crossed communication is established connected the exhaust pipe of one of the cylinders or the cylinder considered to the injection member of the other cylinder.

19. The method as claimed in claim 18 applied to an engine in which each of said cylinders comprises a pump crank case and a transfer duct, wherein a part of the compressed gases coming from the pump crank case of the cylinder considered is directed towards the injection member of this same cylinder and is combined with the gas coming from the communication between the exhaust pipe of the other cylinder with the injection member of the cylinder considered.

20. The method as claimed in claim 16 applied to an engine comprising at least two cylinders, at least one of these cylinders comprising a pump crank case, a transfer duct, wherein a part of the compressed gases coming from said pump crank case is directed towards the injection member of another cylinder.

21. The method as claimed in claim 20 applied to an engine in which each cylinder comprises an exhaust pipe, wherein said communication connects the exhaust pipe of said other cylinder to the injection member of this same cylinder and at least a part of the compressed gases coming from said pump crank case is directed towards the injection member and is combined with the gases coming from said communication.

* * * * *